United States Patent [19]

Zukausky

[11] 4,450,696

[45] May 29, 1984

[54] VENTURI POWER SUPPLY AND ACTUATOR SYSTEM

[75] Inventor: Keith E. Zukausky, Hanover, Ill.

[73] Assignee: Eaton Corporation, Cleveland, Ohio

[21] Appl. No.: 400,780

[22] Filed: Jul. 22, 1982

[51] Int. Cl.[3] ..... D06F 33/08

[52] U.S. Cl. ..... 68/18 FA; 60/413; 60/908; 68/207; 91/36; 134/57 D

[58] Field of Search ..... 68/12 FA, 207; 134/57 R, 57 D; 60/908, 409, 412, 413; 91/35, 36

[56] References Cited

U.S. PATENT DOCUMENTS

| | | | |
|---|---|---|---|
| 2,894,533 | 7/1959 | Banker | 60/413 X |
| 3,142,966 | 8/1964 | Rice | 60/413 |
| 3,237,529 | 3/1966 | Beck et al. | 91/36 |
| 3,375,686 | 4/1968 | Palmer | 68/12 FA |
| 3,646,758 | 3/1972 | Cripe | 60/409 X |

FOREIGN PATENT DOCUMENTS

| | | | |
|---|---|---|---|
| 565501 | 11/1958 | Canada | 60/413 |

*Primary Examiner*—Philip R. Coe

*Attorney, Agent, or Firm*—C. H. Grace; R. A. Johnston

[57] ABSTRACT

A control system for a washing machine having an aspirator connected to the discharge side of the inlet valve. The aspirator vacuum port provides a vacuum signal through a one-way valve to a vacuum reservoir which supplies a vacuum signal via a control valve to one or more vacuum responsive diaphragm actuators. The force output of the actuators is employed for auxiliary machine functions such as direct mechanical actuation of the drain valve or operating the recirculation pump motor start switch.

12 Claims, 5 Drawing Figures

CS
SOL.
V
CK
M
P
L1
L2

VENTURI POWER SUPPLY AND ACTUATOR SYSTEM

BACKGROUND OF THE INVENTION

The present invention relates to control systems for appliances for cleansing articles immersed in a receptacle containing fluid and in particular relates to household washing machines and dishwashers. Appliances of this type are usually connected to the household water line and have an electrically operated inlet valve for controlling water fill in the appliance receptacle or tub.

The sequence of operation and timing of these operations in known appliance control systems is controlled by a programmer-timer which opens and closes a series of electrical switch contacts for energizing individual circuits for controlling electrically operated devices such as the inlet valve, water recirculation or spray pump and the drain valve or pump. The programmer-timer in one type of known control system employs a timing motor of very low power capacity to advance a series of cam mechanisms for actuating the various electrical switch contacts. This arrangement of the programmer-timer has been found suitable for providing the capability of switching the substantial currents required for certain machine control functions such as the drain valve, solenoid, and pump motor start-up.

It has long been desired to eliminate the electromechanical programmer-timer from domestic appliances in order to provide more complex and sophisticated control functions utilizing electronic logic and solid state circuitry. However, where solid state circuitry and electronic logic have been employed for programming-/timing functions in place of an electromechanical programmer-timer, it has been found quite difficult to provide a solid state switching device capable of handling the current loads of motor start up and heavy solenoid operation. Consequently, appliances having solid state electronic logic program control have required costly relays to accommodate the current loads of certain control functions.

Thus, it has been desired to find a means or a way of controlling washing machine cycle functions with respect to sequence and timing by employing electronic logic and solid state circuitry and yet provide the capability of switching current loads which would require prohibitively costly switching devices such as electrical relays.

SUMMARY OF THE INVENTION

The present invention provides a control system for a washing appliance of the type employing an electrically energized water inlet valve for controlling flow of filling fluid to the washing receptacle or tub. The present invention employs an aspirator receiving the fluid discharge from the inlet valve in such a manner as to create a source of vacuum at the aspirator throat pressure tap.

The aspirator provides a source of vacuum employed for operating one or more fluid pressure responsive diaphragm-servo-actuators. The output of the servo-actuators is then employed for direct mechanical actuation of appliance control functions such as the tub drain valve, or for directly actuating electrical switches for controlling heavy current loads.

The vacuum from the aspirator is applied to a one-way valve through a vacuum reservoir. The reservoir is tapped to provide the vacuum signal source, through an electrically operated vacuum control valve, to each of the servo-actuators.

The power requirements for the servo-actuator vacuum control valve are quite low; therefore, the electrically operated vacuum valves may be directly powered by low power solid state switching circuit devices. Thus, the present invention provides a control system for a washing appliance in which the programmer-timer may comprise an all electronic solid state device which controls vacuum powered servo-actuators having sufficient force output to perform required machine control functions. The vacuum source is provided by an aspirator receiving fluid discharge from the appliance inlet valve.

The present invention thus provides a unique control system for a washing appliance in which the flow of water from the inlet valve generates a vacuum signal in an aspirator, which vacuum signal is employed to power servo-actuators for providing the force output necessary for machine function control. Lower power electrically operated vacuum valves control the vacuum signal to the servo-actuators thereby enabing all electronic control of the machine service cycle.

DETAILED DESCRIPTION

Figure 1:
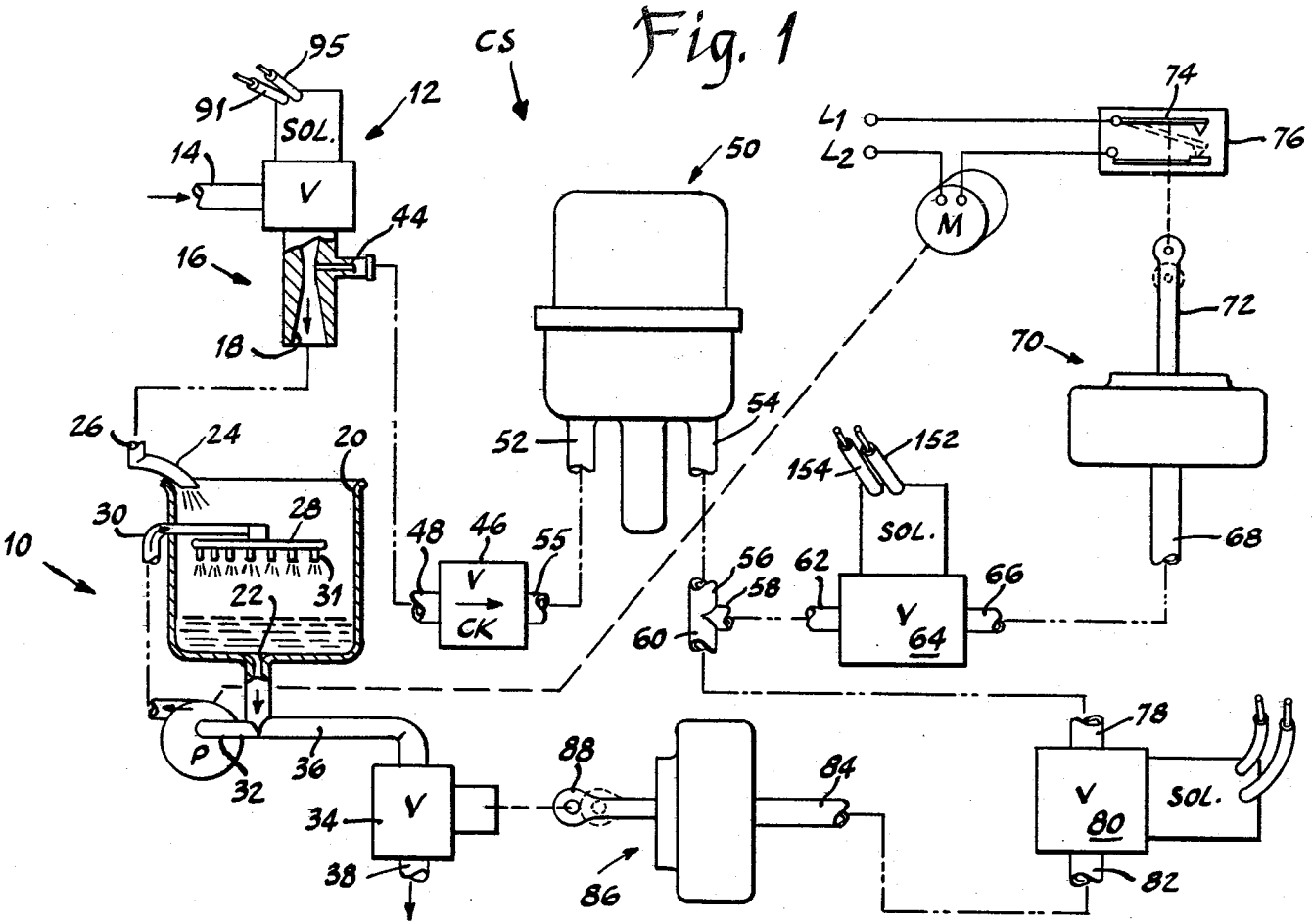
FIG. 1 is a schematic representation of the control system of the present invention as employed in a household dishwasher.

Referring now to FIG. 1, the control system indicated generally by the reference letters "CS" is shown as embodied in an automatic dishwasher indicated generally at 10 and as having an electrically operated inlet valve indicated generally at 12. The valve 12 has an inlet 14 and an outlet which discharges through a venturi-type aspirator indicated generally at 16 and discharges through a diffuser at outlet 18. The details of aspirator 16 will be described hereinafter in greater detail.

The dishwasher 10 has a tub 20 having a drain port 22 and a filling spout 24 connected to aspirator outlet 18 by a conduit 26. A spray bar 28 is disposed within tub 20 and has a supply pipe 30 connected thereto through the wall of tub 20. The spray bar 28 has a plurality of discharge ports 31 for providing washing action on the articles received within the tub 20.

A recirculation pump indicated by the reference letter "P" is provided with inlet thereof connected to drain port 22 via conduit 32 and the discharge side of the pump connected through fill pipe 30 to the spray bar. A preferably mechanically actuated drain valve 34 is provided and has the inlet thereof connected also to drain port 22 via conduit 36. The outlet 38 of the drain valve is connected to the drain or sewer for discharging wash water from the machine.

Figure 2:
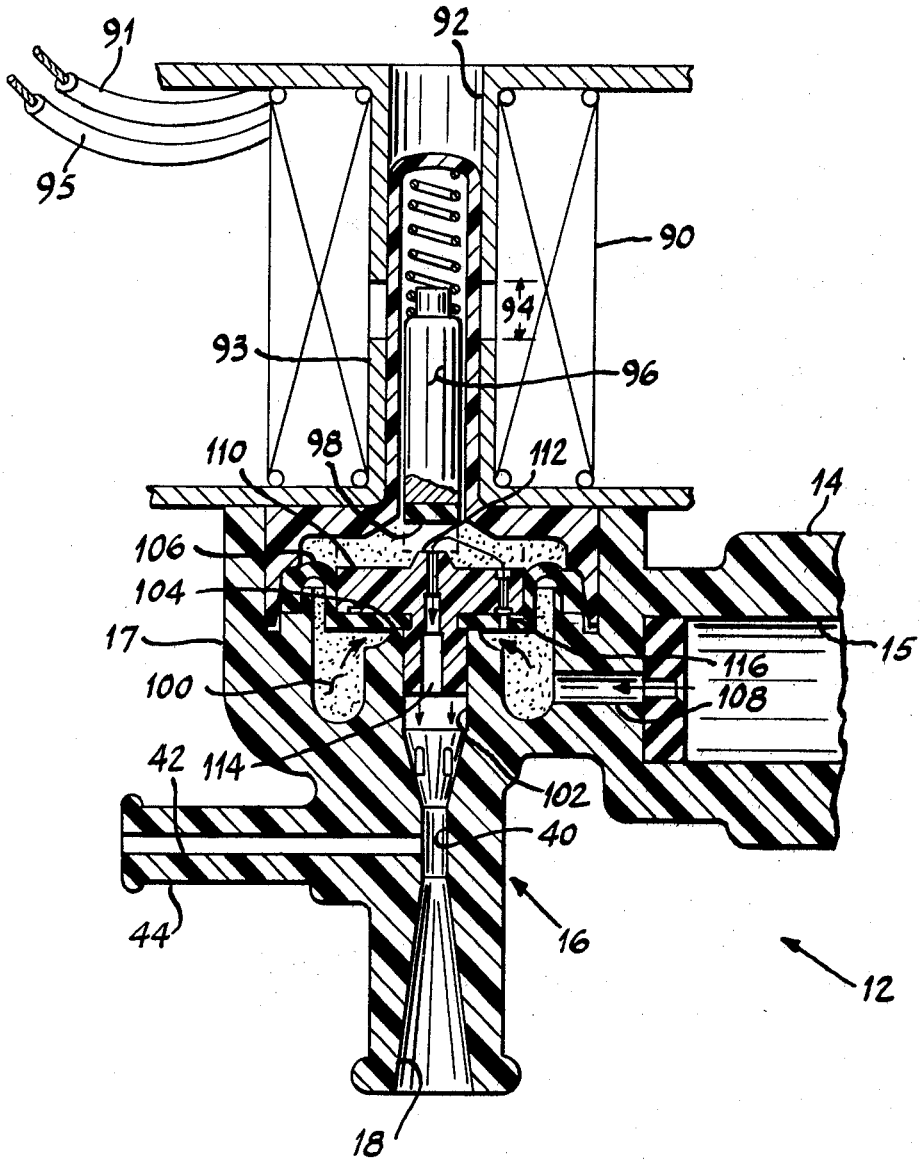
FIG. 2 is an enlarged crosssectional view of the electrically operated water inlet valve of the system of FIG. 1.

Referring to FIGS. 1 and 2, aspirator 16 has the venturi throat 40 thereof provided with a pressured cap port 42 which extends outwardly through a connector 44 which provides a vacuum source for the control system upon flow of fluid through throat 40.

Referring now to FIG. 1, a one-way check valve 46 is provided; and, valve 46 has inlet thereof connected to vacuum connector 44 via conduit 48. The one-way valve 46 may comprise any suitable valve construction such as a diaphragm, poppet or ball type valve known in the art. Arrow shows vacuum flow not air flow through valve 46.

A vacuum reservoir in the form of an accumulator indicated generally at 50 has an inlet fitting 52 connected via conduit 55 to the outlet of one-way valve 46. The accumulator has an outlet fitting 54 which is operatively connected to distributor fitting 56 in the form of a "Y" or "T" having branch outlets 58 and 60. The details of the accumulator 50 will be hereinafter described in greater detail with reference to FIG. 4.

With continuing reference to FIG. 1, the branch outlet 58 of vacuum fitting 56 is connected via conduit 62 to the inlet of an electrically operated vacuum valve 64 which will be described in greater detail hereinafter. The outlet of valve 64 is connected via conduit 66 to the inlet fitting 68 of vacuum servo-actuator indicated generally at 70, which will be described in greater detail hereinafter. The servo-actuator 70 has an output force member 72 movable between the positions indicated in solid outline and dashed outline in FIG. 1.

Force member 72 is operatively connected to a movable arm member 74 of an electrical switch 76 series connected to power lines L1, L2 and to a motor "M" which has the shaft thereof operatively connected for operating recirculation pump "P" as indicated by the dashed outline in FIG. 1.

The branch outlet 60 of fitting 56 is connected via conduit 78 to the inlet of an electrically operated vacuum valve 80, which in the presently preferred practice, is identical to the valve 64. The outlet of the vacuum valve 80 is connected via conduit 82 to the inlet fitting 84 of a second vacuum servo-actuator indicated generally at 86. The servo-actuator 86 has an output force member 88 movable between the positions shown in solid and dash outline in FIG. 1. Force outlet 88 is operatively connected preferably by mechanical linkage to actuate valve 34 as indicated by the dashed line in FIG. 1. The servo-actuator 86 in the presently preferred practice is identical to servo-actuator 70 in the style of construction. However, area and stroke of the actuator may be adjusted for manufacturing cost and power consumption considerations.

Referring now to FIG. 2, the inlet valve 12 is shown in greater detail as having an electrical coil 90 with ferromagnetic pole pieces 92, 93 disposed therewithin to define an air gap 94. The coil 90 is energized by an electronic programmer-timer (not shown) through power leads 91, 95. A ferromagnetic armature 96 is received within the pole pieces and has a pilot valve member in the form of resilient pad 98 disposed on the end thereof. The valve 16 has formed in the body 97 thereof an inlet port 15 in fitting 14, the inlet communicating with an annular chamber 100 disposed about outlet passage 102 and surrounding main valve seat 104.

A resilient diaphragm 106 is sealed about its outer periphery to body 97 and seats on its undersurface against the valve seat 104 to cut off flow from chamber 100, as supplied through bore 108 from inlet 15, to outlet 102. A diaphragm insert 110 has a pilot valve seat 112 provided thereon and a pilot passage 114 formed therethrough for communicating the chamber formed by the upper face of diaphragm 106 with outlet 102.

A bleed passage 116 is provided through the diaphragm 104 to provide bleed communication between chamber 100 and the chamber formed by the upper surface of the diaphragm 106. The bleed passage 116 thus permits pressure equalization between chamber 100 and the chamber above the diaphragm. The valve 12 is thus a solenoid actuated, pilot operated valve of the type known in the art.

The valve 12 as shown in FIG. 2 has the main valve closed, with the pilot valve 98 in the just-opened position wherein water has begun to flow through pilot passage 114 but has not yet caused significant pressure difference between chamber 100 and the chamber above the diaphragm. As water continues to flow through pilot passage 114, the pressure above the diaphragm drops and the pressure acting on the under surface of diaphragm 106 causes the diaphragm and insert 110 to rise away from main valve seat 104 thereby opening the main valve and permitting water to flow from chamber 100 directly into passage 102 and into the inlet of aspirator throat 40.

Figure 3:
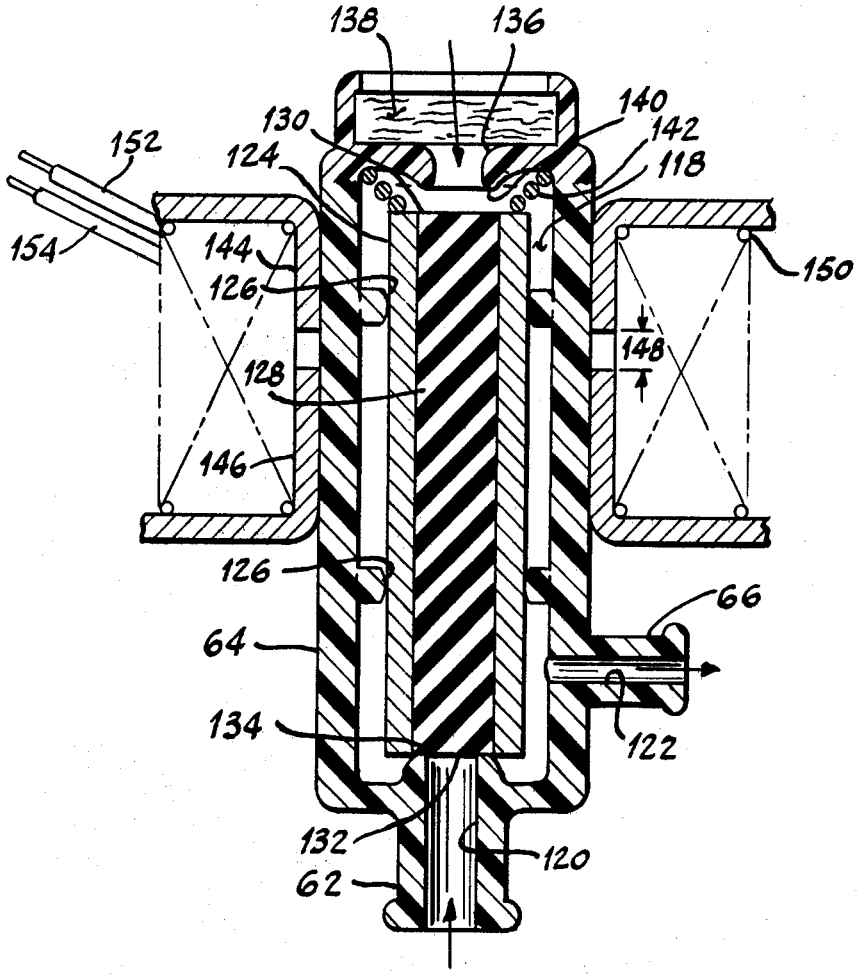
FIG. 3 is an enlarged crosssectional view of a typical electrically operated vacuum control valve of the system of FIG. 1.

Referring now to FIG. 3, the details of the electrically operated vacuum control valve 64 is shown and in the present practice of the invention the valve 80 is a duplicate of control valve 64. The valve 64 has a valving chamber 118 communicating with the exterior through port 120 inlet fitting 62 and through port 122 formed in fitting 66. A ferromagnetic armature 124 is slidably received in the chamber 118 and guided for movement therein by any suitable expedient such as a plurality of ribs 126 disposed about the inner periphery of body 64 in circumferentially spaced arrangement. Armature 124 has a resilient core 128 which extends to the opposite ends thereof to form valving surfaces 130, 132.

A raised vacuum valve seat 134 is formed about the upper end of inlet passage 120 for contacting the valve seating surface 132 to prevent vacuum communication to chamber 118.

The upper end of valve 64 has a vent port 136 provided therein for communicating via a retained filter element 138 with the atmosphere. A raised annular vent seat 140 is provided annularly about vent 136 and is adapted for contact and closure thereof by the valving surface 130 of the armature upon upward movement thereof.

The armature is biased downwardly to the vacuum valve closed position shown in FIG. 3 by a conical spring 142 disposed in chamber 118 registering against the upper face of armature 124.

Valve 64 has received therewithin a pair of axially spaced annular pole pieces 144, 146 which define therebetween an air gap 148 actually therealong. An electric coil 150 is wound about the pole pieces for energization through leads 152, 154. Upon energization of coil 150, armature 124 moves upward to raise valving surface 132 away from the valve seat 134 and to permit vacuum communication from accumulator 50 to chamber 118 and outlet port 122. Upon energization, the ferromagnetic armature 124 seeks a null position axially equipoised about air gap 148 and thus moves upwardly causing valving surface 130 to seat against vent seat 140 and close off vent port 136 to chamber 118. This action enables chamber 118 to achieve the vacuum level supplied through inlet 120 for communicating a corresponding vacuum signal through outlet 122.

Figure 4:
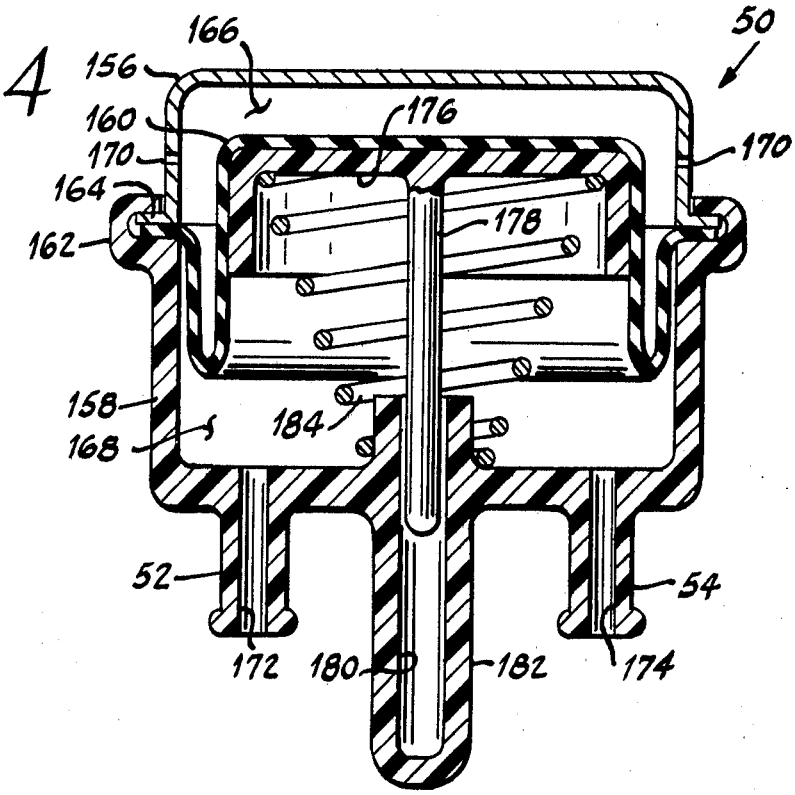
FIG. 4 is an enlarged crosssectional view of vacuum accumulator of the system of FIG. 1.

Referring now to FIG. 4, the accumulator 50 is shown in crosssection as having an upper cup-shaped shell 156 and a lower cup-like shell 158 preferably formed of plastic material. A resilient diaphragm 160 has its outer periphery sealed about the inner periphery of the shells 156, 158 by a suitable expedient such as the rim flange 162 being formed over a corresponding flange 164 formed on the upper shell. The diaphragm cup 160 thus divides the accumulator into an upper chamber 166 and a lower chamber 168, with the upper chamber vented to the atmosphere through suitable ports 170. The lower shell 158 has formed therein inlet fitting 52 having an inlet port 170 communicating with the chamber 168, and an outlet fitting 54 having an outlet port 174 communicating with chamber 168.

Diaphragm 160 has a backing or insert cup 176 provided on the under surface thereof, which cup has a guide rod 178 provided thereon and extending downwardly therefrom. A downwardly extending portion 182 is provided on the lower shell 158 and guide rod 178 is received slidably therein in a guide bore 180 therein. A suitable biasing means in the form of a preferably conical spring 184 is provided in chamber 168 and the spring registers against the under surface of cup 176 on its upper end and the inner wall of shell 158 at its lower end for urging the diaphragm in an upward direction.

In operation, as a vacuum is drawn through inlet port 172, the spring 184 prevents collapse of the diaphragm 160 against the lower shells, and thereby provides sufficient volume for vacuum storage in the accumulator.

Figure 5:
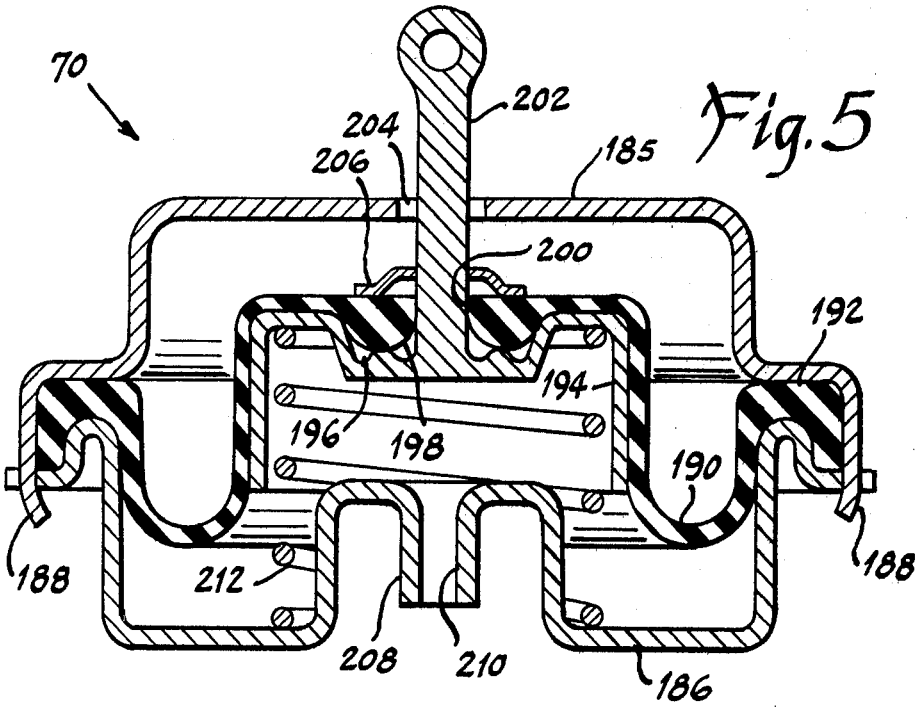
FIG. 5 is a crosssectional view of a typical vacuum operated servo-actuator of the system of FIG. 1.

Referring now to FIG. 5, the typical servo-actuator 70 is illustrated as having an upper housing shell 184 and a lower housing shell 186 mechanically interconnected about the peripheral rims thereof by a suitable expedient, as for example bent portions or tabs 188. A resilient diaphragm member 190 is disposed within the housing shell portions 184, 186 and is sealed about the periphery thereof between the rim flanges of the shells by compression of a rim bead portion 192. The diaphragm thus forms a pressure chamber with the interior of lower shell 186.

A diaphragm insert member 194 having a generally cup-shaped configuration is received in the central region of the diaphragm on the under surface thereof and has a raised bead ring 196 thereon which contacts a corresponding inner peripheral bead ring 198 provided on the diaphragm 190.

The diaphragm has a central aperture 200 provided therein which has a force output member 202 extending upwardly therethrough and outwardly through aperture 204 provided in the upper shell 184. In the presently preferred practice the force output member 202 is formed integrally with insert cup 194; however, it will be understood that the force output member 202 may be formed separately and attached to the insert cup 194 by any suitable fastening expedient.

A seal retainer ring 206 is received over the force output member, and in the presently preferred practice, frictionally engages the output member for retaining bead ring 198 in sealing engagement with the insert bead 196.

A vacuum input connector 208 is formed in the central region of the lower shell 186 and has a vacuum port 210 provided therein for communication with the interior of the shell 186 in the region below diaphragm 190. In the presently preferred practice the connector 208 is adapted for connection to a vacuum hose such as conduit 68 (see FIG. 1). It will be understood that, although the connector 208 is illustrated as formed integrally with lower shell 186, it may be formed separately and joined thereto by any suitable fastening expedient known in the art.

In operation, as the machine programmer (not shown) electrically energizes the inlet valve 12 through power leads 91, 95 a flow of water is created through the aspirator 16 for filling the washing tub 20. As water flows through the aspirator, a vacuum is generated and applied through conduit 44 and check valve 46 to accumulator 50. The vacuum from accumulator 50 is applied through branch conduit 58 to valve 64 and through branch conduit 60 to valve 80.

Upon energization of the valve 64 through power leads 154, 152 selectively by the electronic programmer-timer (not shown), a vacuum signal at the valve output is transmitted through conduit 66 to the inlet of vacuum servo-actuator 70. The servo-actuator 70 through its output member 72 closes switch 76 by movement of the contact arm 74 to complete a circuit to the pump motor "M" for energizing the pump "P". The pump recirculates water in the tub through the spray bar 28 for cleansing the articles disposed within the tub. Upon de-energization and closing of the valve 64, the return spring in servo-actuator 70 moves the output member 72 upward opening switch 76 and shutting off the pump motor.

At the desired time in the machine cycle, the electronic programmer-timer (not shown) selectively energizes the valve 80 for applying vacuum from branch 60 to the inlet 84 of vacuum servo-actuator 86. The servo-actuator output member 88 is then mechanically moved to actuate valve 34 to the open position for draining wash water from the tub 20 via conduit 36 and conduit 38. Upon the closing of valve 80, the loss of vacuum on servo-actuator 86 permits the return spring therein to move output member 88 for closing the drain valve 34.

Although the invention has been hereinabove described with reference to the preferred practice illustrated in the drawings, it will be understood by hose having ordinary skill in the art that the invention is capable of modification and variation within the scope of the following claims.

I claim:

1. A control system for a washing appliance comprising:

(a) a valve adapted for connection at its inlet to a source of pressurized liquid and including electrically operated actuator means operative upon electrical energization and de-energization to effect opening and closing of said valve;

(b) means defining a venturi having a converging inlet, a throat and an outlet diffuser with the inlet thereof connected to the outlet of said valve for receiving fluid flow therefrom;

(c) pressure tap means defining a fluid port in the throat of said venturi;

(d) receptacle means for receiving the articles to be washed;

(e) conduit means operatively connected for directing fluid from the venturi outlet diffuser to said receptacle means;

(f) one-way valve means having the inlet thereof connected to said venturi throat port;

(g) means defining a fluid pressure reservoir having an inlet including means connecting said reservoir to the outlet of said one-way valve means;

(h) fluid pressure servo-actuator means having a pressure signal inlet connected to receive the fluid pressure in said reservoir, said servo-actuator having an output member and operative to provide an output force and movement of said member in response to a fluid pressure signal from said reservoir; and, (i) electrically operated valve means for controlling flow between said reservoir and said servo-actuator means.

2. The control system defined in claim 1, further comprising electrically actuatable valve means fluidly intermediate said reservoir means and said servo-actuator means and operable upon actuation and deactuation to respectively permit and prevent fluid communication between said reservoir and said servo-actuator.

3. The control system defined in claim 1, further comprising (a) drain valve means mechanically actuatable for opening and closing a drain in said receptacle; and (b) a second fluid pressure servo-actuator means having a pressure signal inlet connected to receive the fluid pressure in said reservoir, said second servo-actuator having a force output member operatively connected for actuation of said drain valve means.

4. The control system defined in claim 1, further comprising:

(a) pump means operable to recirculate liquid in said receptacle and effect spray discharge upon articles placed therein for washing;

(b) electrical switch means having a switch member connected to said servo-actuator output member for movement therewith, said switch means being operative upon connection to a source of power and movement of said output member to effect operation of said pump means.

5. A control system for a cleansing appliance comprising:

(a) inlet valve means adapted for connection to a source of fluid pressure operative upon electrical energization to provide a flow of pressurized fluid and upon de-energization to block flow of fluid;

(b) aspirator means receiving fluid flow from said inlet valve means and operative thereupon to provide a source of sub-atmospheric pressure;

(c) means defining a fluid receptacle for receiving articles to be cleansed;

(d) flow directing means operative to direct fluid flow from said aspirator means to said receptacle;

(e) accumulator means including check valve means operative to store fluid at said sub-atmospheric pressure;

(f) fluid pressure responsive actuator means operatively connected to said sub-atmospheric pressure in said accumulator for providing in response thereto a mechanical force output on a member; and, (g) electrically operated valve means operative to control fluid pressure communication between said accumulator and said actuator means.

6. The control system defined in claim 5, further comprising:

fluid pressure reservoir means disposed to receive said sub-atmospheric pressure from said aspirator means.

7. The control system defined in claim 6, further comprising pump means operative upon energization to recirculate fluid in said receptacle and switch means operatively connected to said actuator means for energizing said pump means in response to said sub-atmospheric pressure from said aspirator means.

8. The control system defined in claim 6, further comprising drain valve means operatively connected to said actuator means for draining said receptacle.

9. The control system defined in claim 5, further comprising:

(a) fluid pressure reservoir means disposed to receive said sub-atmospheric pressure from said aspirator means;

(b) one-way valve means fluidly disposed between said aspirator means and said reservoir means and operative to prevent loss of sub-atmospheric pressure in said reservoir means.

10. The control system defined in claim 5, further comprising a plurality of said actuator means and wherein said valve means comprises an individual valve for controlling fluid pressure communication between said aspirator means and each of said actuator means.

11. The control system defined in claim 5 wherein said valve means includes electrically energizeable means operative for effecting opening and closing of said valve means.

12. In a control system for a cleansing appliance of the type having a receptacle for receiving articles to be cleansed and an electrically operated inlet valve for controlling fluid flow from a source of pressurized fluid to said receptacle, with said receptacle having a drain port provided therein, the improvement comprising:

(a) aspirator means receiving fluid discharge from said inlet valve and operative to discharge fluid to said receptacle, said aspirator means having a vacuum port and operative to provide a vacuum signal at said port upon flow of fluid from said inlet valve through said aspirator;

(b) fluid flow control valve means operative upon actuation to control flow of fluid from said drain port;

(c) fluid pressure responsive actuator means having a fluid pressure signal inlet and operative upon connection to a source of fluid pressure signal to provide a force output on a member;

(d) conduit means connecting said aspirator vacuum port to said actuator means inlet port for providing said vacuum signal to said actuator means;

(e) accumulator means disposed in said conduit means and including one-way valve means;

(f) operator means responsive to said actuator force output for effecting actuation of said fluid flow control means; and, (g) electrically operated control valve means operative to control fluid flow in said conduit means.

* * * * *